US007673639B2

(12) United States Patent
Shin

(10) Patent No.: US 7,673,639 B2
(45) Date of Patent: Mar. 9, 2010

(54) WASHING ARM AND DISHWASHER HAVING THE SAME

(75) Inventor: Gap Su Shin, Cheongju-si (KR)

(73) Assignee: LG Electronics Inc., Seoul (KR)

( * ) Notice: Subject to any disclaimer, the term of this patent is extended or adjusted under 35 U.S.C. 154(b) by 234 days.

(21) Appl. No.: 11/764,654

(22) Filed: Jun. 18, 2007

(65) Prior Publication Data

US 2007/0289615 A1 Dec. 20, 2007

(30) Foreign Application Priority Data

Jun. 19, 2006 (KR) ..... 10-2006-0055098

(51) Int. Cl.
*B08B 3/04* (2006.01)

(52) U.S. Cl. ..... 134/172

(58) Field of Classification Search ..... 134/172
See application file for complete search history.

(56) References Cited

U.S. PATENT DOCUMENTS 3,348,775 A * 10/1967 La Flame ..... 239/227
3,538,927 A * 11/1970 Wallgren ..... 134/144
4,827,563 A * 5/1989 Gordon ..... 15/402
5,267,582 A * 12/1993 Purtilo ..... 134/180

* cited by examiner

*Primary Examiner*—Frankie L Stinson
*Assistant Examiner*—Samuel A Waldbaum
(74) *Attorney, Agent, or Firm*—Birch, Stewart, Kolasch & Birch, LLP

(57) ABSTRACT

A washing arm and a dishwasher having the washing nozzle are provided. The washing arm includes a first arm capable of rotating by wash liquid flowing therethrough, and a second arm rotating with respect to the first arm through wash liquid supplied from the first arm.

4 Claims, 6 Drawing Sheets

WASHING ARM AND DISHWASHER HAVING THE SAME

The present application claims priority under 35 U.S.C. 119 and 35 U.S.C. 365 to Korean Patent Application No. 10-2006-0055098 (filed on Jun. 19, 2006), which is hereby incorporated by reference in its entirety.

BACKGROUND

The present disclosure relates to a washing arm for spraying wash liquid and a dishwasher with the washing arm.

In general, a dishwasher is an appliance that sprays wash liquid at high pressure to wash food residue from surfaces of dishes.

Specifically, a dishwasher includes a tub forming a wash compartment, and a sump installed at the lower surface of the tub to hold wash liquid.

Through the pumping action of a wash pump installed within the sump, wash liquid flows to washing nozzles/arms. The wash liquid that flows to the washing nozzles/arms is sprayed at high pressure through spray holes formed in the nozzles/arms. The wash liquid that is sprayed at high pressure collides against surfaces of dishes, removing food deposits and other impurities from the dishes onto the floor of the tub.

A dishwasher thus sprays wash liquid from the washing nozzles/arms to remove food deposits from dishes, and rotates the washing arms in clockwise/counterclockwise directions horizontally to more effectively perform washing of the dishes.

However, in a typical dishwasher, even when a washing arm is rotated, there are areas within the tub that wash liquid does not directly contact, so that dishes are not thoroughly washed.

SUMMARY

Embodiments provide a washing arm that rotates omnidirectionally to thoroughly wash dishes by increasing the area that can be washed, and to a dishwasher having the washing arm.

In one embodiment, a washing arm includes: a first arm capable of rotating by wash liquid flowing therethrough; and a second arm rotating with respect to the first arm through wash liquid supplied from the first arm. The first arm rotates in a horizontal direction, and the second arm is rotatably coupled to the first arm and rotates in a vertical direction.

A dishwasher according to the embodiments of the present disclosure washes dishes using the above washing arm.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
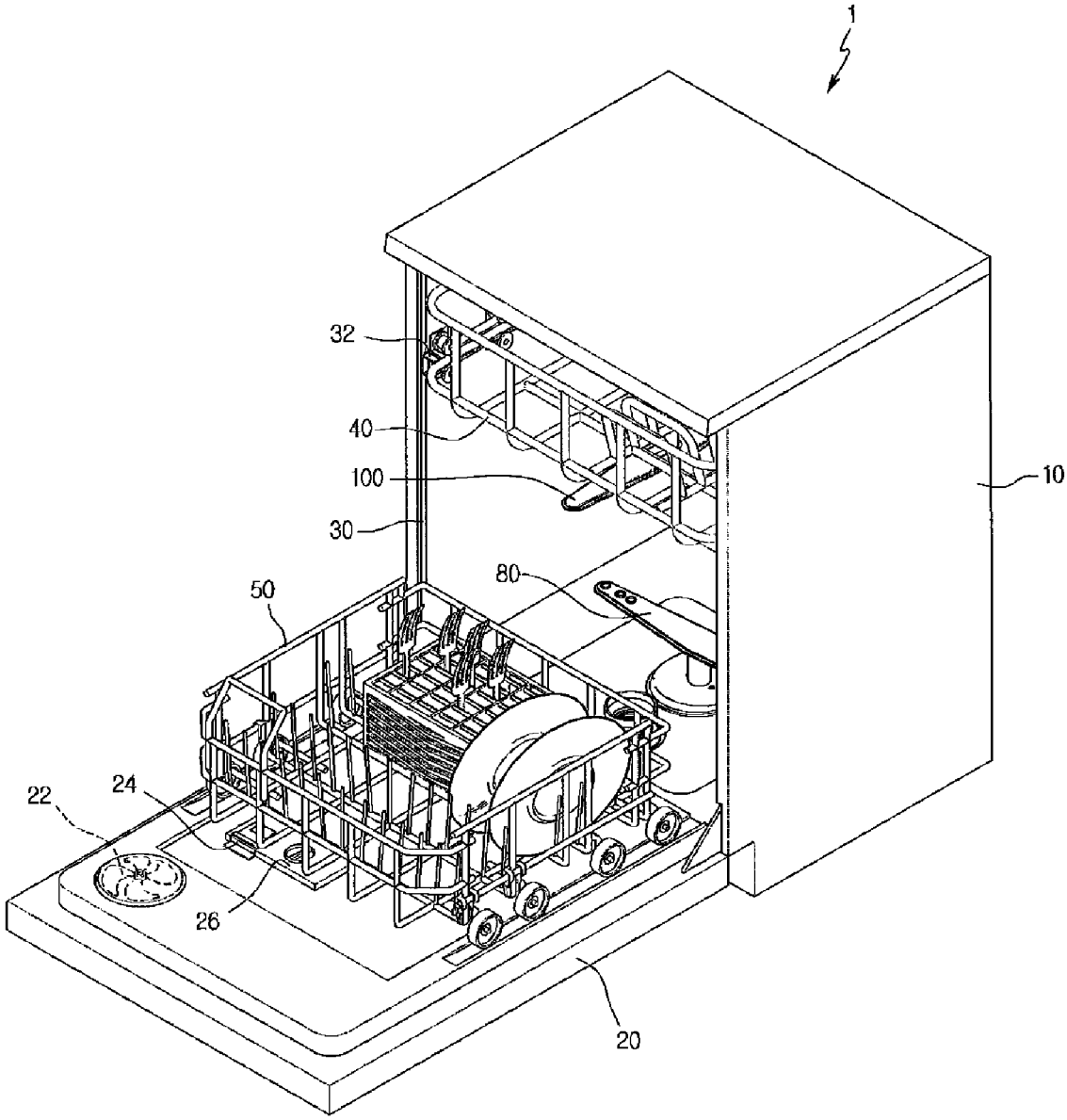
FIG. 1 is a perspective view of a dishwasher with the door open.
Figure 2:
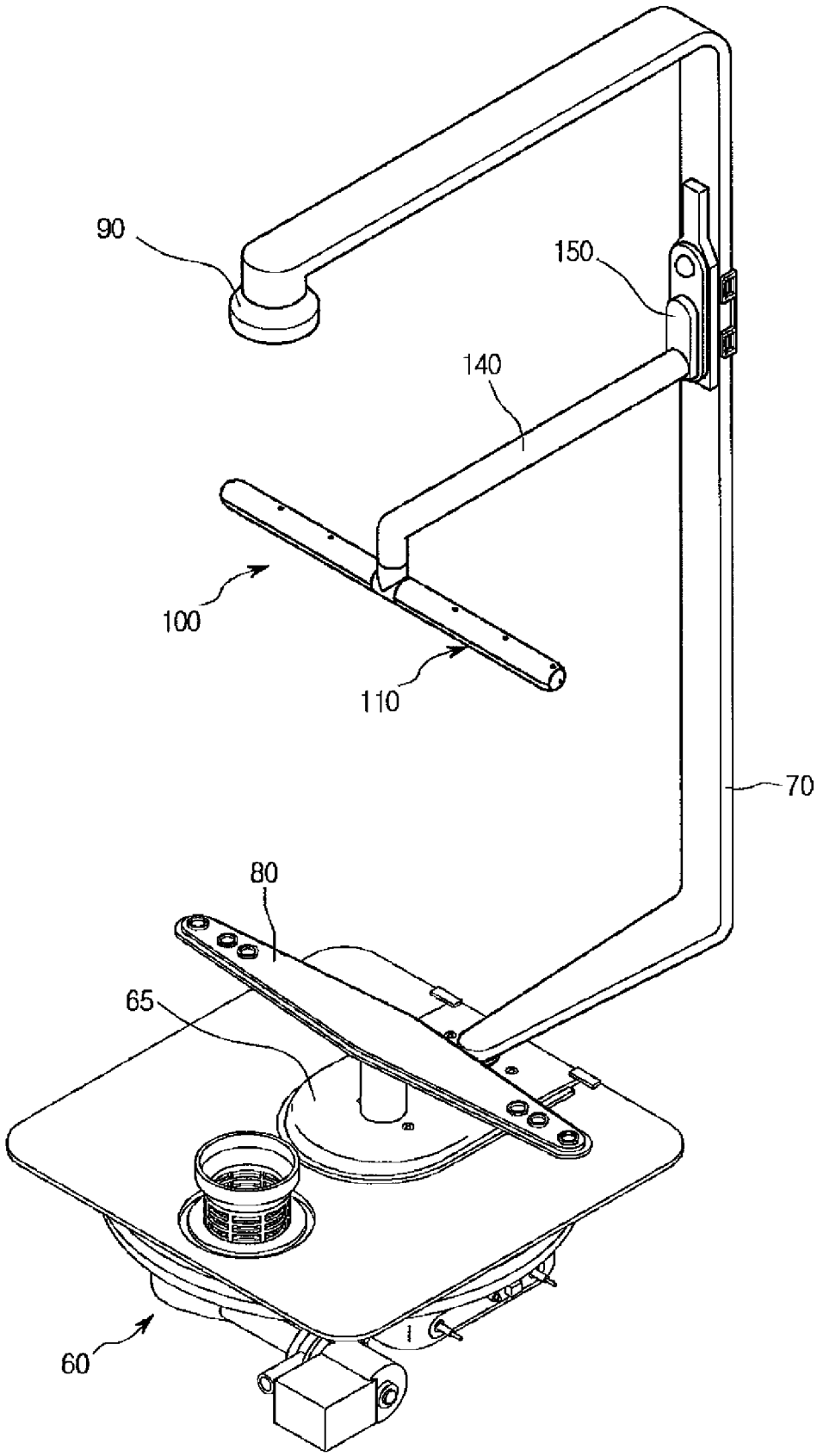
FIG. 2 is a perspective view of a structure for supplying wash liquid in a dishwasher.

FIG. 1 is a perspective view of a dishwasher with the door open according to an embodiment of the present disclosure, and FIG. 2 is a perspective view of a structure for supplying wash liquid in a dishwasher.

Referring to FIGS. 1 and 2, a dishwasher 1 according to an embodiment of the present disclosure includes a case 10 forming an exterior thereof, a door 20 for opening and closing an opening at the front of the case 10, a tub 30 disposed within the case 10 and forming a wash compartment, a sump 60 installed at the inner, lower portion of the tub 30 for pumping wash liquid, a water guide 70 through which the wash liquid pumped from the sump flows, washing nozzles/arms for spraying wash liquid inside the wash compartment, and dish racks for storing dishes in.

In detail, the dish racks include an upper rack 40 provided at the upper portion of the tub 30, and a lower rack 50 provided below the upper rack 40.

Also, the upper rack 40 and lower rack SO can be pulled out from the tub 30. To allow the upper and lower racks 40 and 50 to be pulled out, rails 32 are formed from front-to-rear inside the tub 30.

The water guide 70 is provided extending vertically on the rear, inner surface of the tub 30. The water guide 70 is connected to the sump 60 to provide a passage for wash liquid pumped from the sump 60.

The washing nozzles/arms include a lower arm 80 connected to the center of the sump 60 for spraying wash liquid toward the lower rack 50, an upper arm 100 provided below the upper rack 40 to spray wash liquid, and a top nozzle 90 coupled to the upper portion of the water guide 70 to spray wash liquid downward.

The upper arm 100 includes a spraying portion 110 that sprays wash liquid, an arm guide 140 for allowing wash liquid flowing through the water guide 70 to flow to the spraying portion 110, and an arm holder 150 formed at the end of the arm guide 140 and pressed against the front surface of the water guide 70.

Also, the upper arm 100 is coupled to the upper rack 40, and moves together with the upper rack.

That is, the upper arm 100 is pulled out together with the upper rack 40 when the latter is pulled out from the tub 30, and the upper arm 100 is pushed in together with the upper rack 40 when the latter is pushed into the tub. When the upper rack 40 is pushed into the tub 30, the arm holder 150 is pressed against the front surface of the water guide 70.

The door 20 is coupled at a lower end thereof to the case 10 by a hinge (not shown), and pivots upward and downward about the hinge when a user manipulates the door 20.

An exhaust fan 22 may be formed at a predetermined position on the door 20 to forcibly expel the air inside the tub 30 to the outside.

A rinse container 24 for supplying rinse during washing is formed on the rear surface of the door 20, and a detergent container 26 for putting a certain amount of detergent into is formed to one side of the rinse container 24.

To describe the operation of the above-structured dishwasher 1 according to the present disclosure, when a start button of the dishwasher 1 is pressed, wash liquid flows into the sump 60. The wash liquid that enters the sump 60 is pumped through a predetermined pumping action into the water guide 70 and the lower arm 80. The wash liquid pumped to the water guide 70 moves respectively to the upper arm 100 and the top nozzle 90 and is sprayed into the tub 30.

Here, the pumped wash liquid is alternately supplied at predetermined intervals to the water guide 70 and the lower arm 80.

Accordingly, dishes are washed by multiply repeating the cycle of wash liquid sprayed inside the tub 30 through the lower arm 80 for a predetermined duration and wash liquid sprayed through the upper arm 100 and the top nozzle 90 after the predetermined duration.

Figure 3:
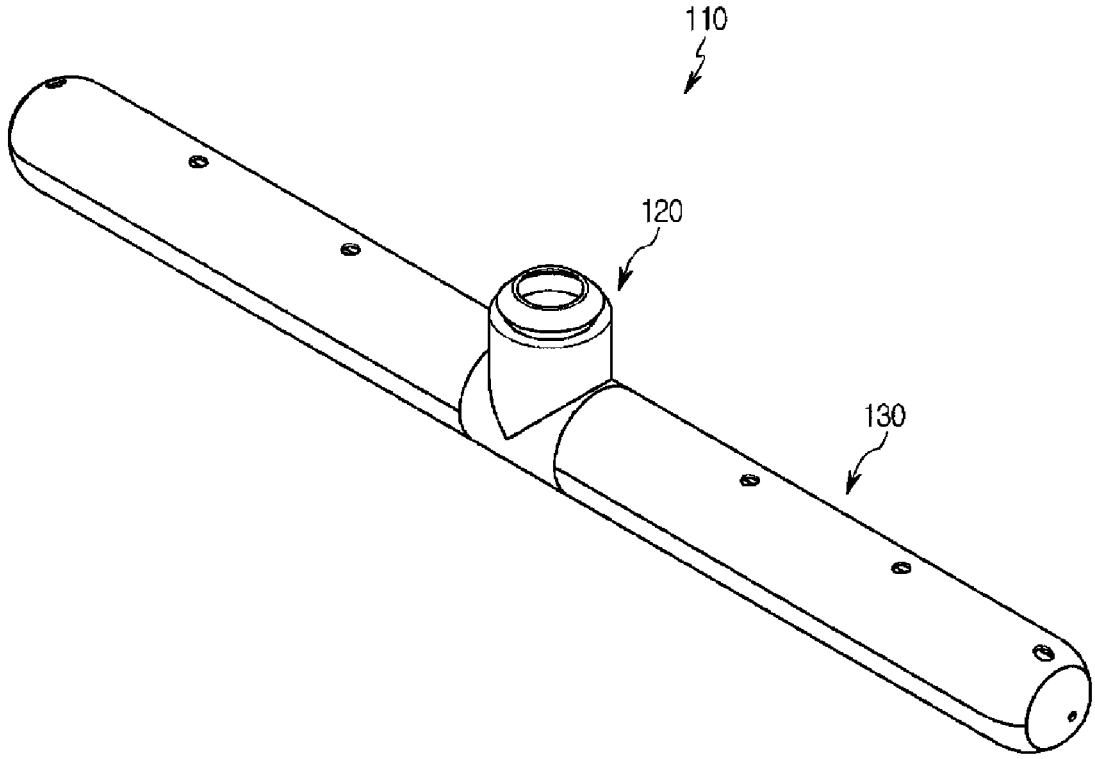
FIG. 3 is a perspective view of a washing arm.
Figure 4:
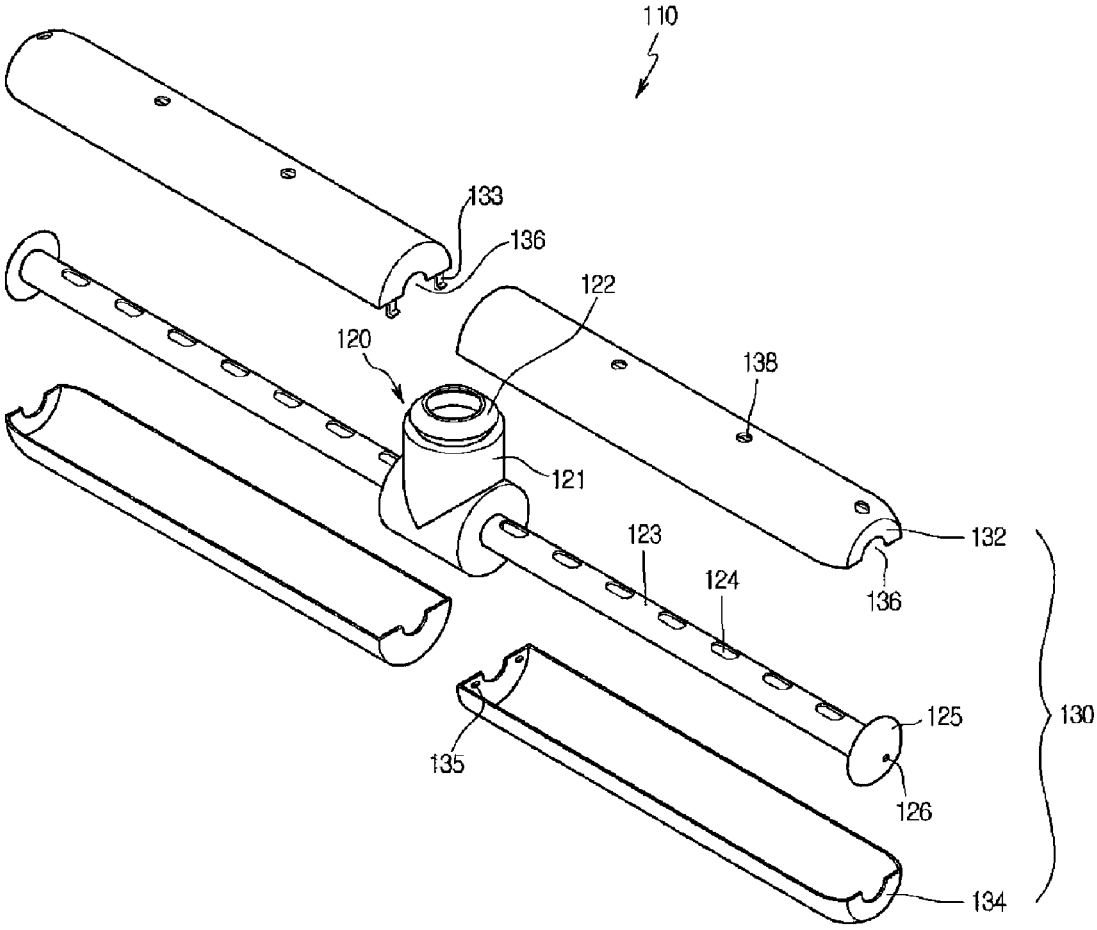
FIG. 4 is an exploded perspective view of the washing arm in FIG. 3.

FIG. 3 is a perspective view of a washing arm, and FIG. 4 is an exploded perspective view of the washing arm in FIG. 3.

Referring to FIGS. 3 and 4, the spraying portion 110 according to the present embodiment is formed to be capable of rotating horizontally and vertically.

The spraying portion 110 includes a first arm 120 coupled to the arm guide 140 to be capable of rotating thereon, and a second arm 130 coupled to the first arm 120 to be capable of rotating thereon.

In detail, the first arm 120 is structured to rotate in a horizontal direction with respect to the arm guide 140. The first arm 120 includes a coupling portion 121 for coupling to the arm guide 140, and a spray arm 123 extending from either side of the coupling portion 121. Also, a coupling guide 122 is formed at the top of the coupling portion 121 to couple to the arm guide 140.

The second arm 130 rotates vertically with respect to the arm guide 140. That is, when the first arm 120 and the second arm 130 rotate, their rotating trajectories perpendicularly intersect.

The first arm 120 can rotate in a horizontal direction so that it can be called a horizontally rotating arm, and the second arm can rotate in a vertical direction so that is can be called a vertically rotating arm.

The second arm 130 includes a first cover 132 and a second cover 134 that are semi-cylindrical and coupled together, and the first and second covers 132 and 134 enclose the spray arm 123. That is, a vertical cross section of the second arm 130 is circular in shape.

Here, the coupling of the first cover 132 and the second cover 134 may be achieved in many ways, including the use of hooks, for example. That is, hooks 133 are formed on the first cover 132, and coupling protrusions 135 are formed on the second cover 134, so that the first cover 132 and the second cover 134 can be coupled together by means of the hooks 133 and the coupling protrusions 135, In further detail, the radius of each cover 132 and 134 is greater than the radius of the spray arm 123, and a space is formed between each of the covers 132 and 134 and the spray arm 123. Also, the spray arm 123 has a plurality of outlets 124 formed therein through which wash liquid is discharged into the space.

A guide 125 is respectively formed on either end of the spray arm 123. The guide 125 presses against the side of the coupled covers 132 and 134, and prevents the second arm 130 from moving outward when the first arm 120 rotates in a horizontal direction. A first discharge hole 126 for discharging wash liquid sideways is formed in the guide 125.

Accordingly, wash liquid that is discharged through the first discharge hole 126 removes impurities on the walls of the tub 30 and the door 20.

Here, the first discharge hole 126 may be formed offset by a predetermined distance from the center of the guide 125 in order to aid in rotating the first arm 120.

Thus, when the first discharge hole 126 is formed offset by a predetermined distance from the center of the guide 125, the first arm 120 can rotate in the opposite direction from the center of the guide 125.

A plurality of second discharge holes 138 for supplying wash liquid is formed in the first cover 132 and the second cover 134, and a fitting recess 136 with a diameter corresponding to that of the spray arm 123 is formed in the first and second covers 132 and 134 to allow the first and second covers 132 and 134 to be coupled to the spray arm 123.

Accordingly, when the first cover 132 and the second cover 134 are mounted on the spray arm 123, the second arm 130 can rotate with respect to the first arm 120.

Figure 5:
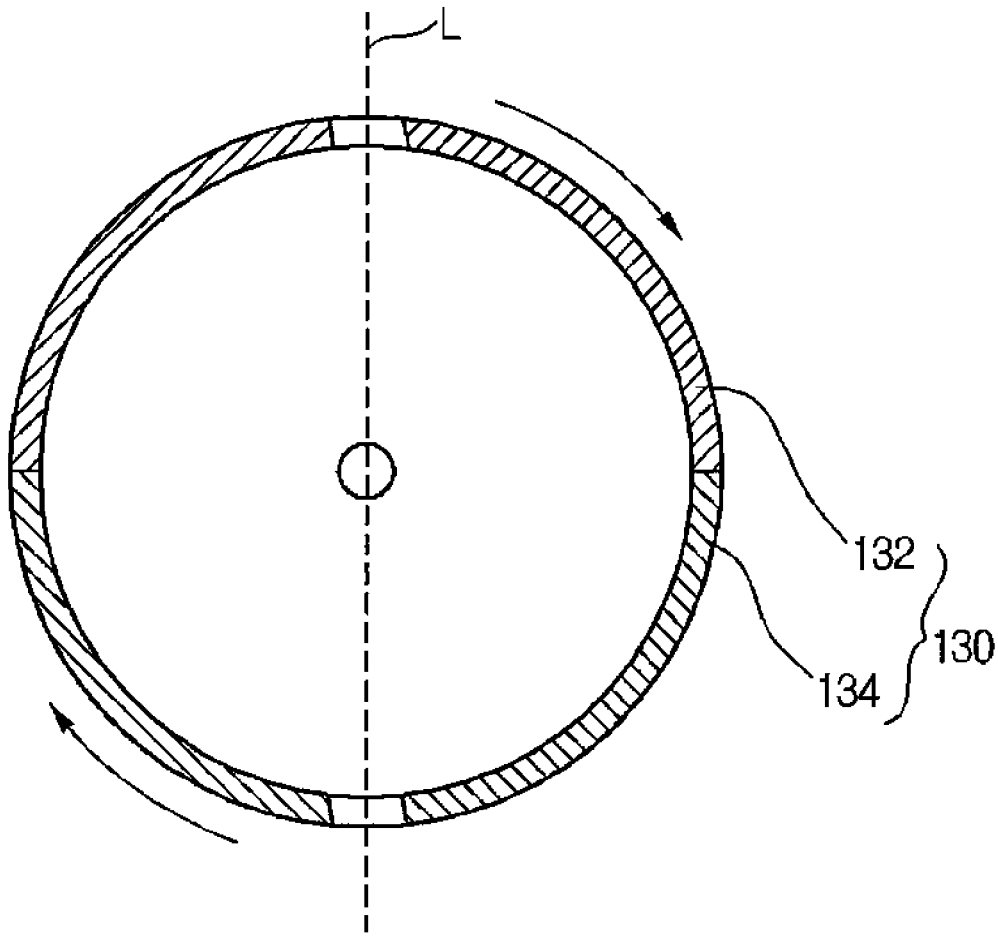
FIG. 5 is a sectional view of a second wash arm.

FIG. 5 is a sectional view of a second wash arm.

Referring to FIG. 5, in the present embodiment, second discharge holes 138 are formed in the first and second covers 132 and 134 such that they are angled to one side from a vertical centerline L along the second arm 130.

In detail, the second discharge holes 138 formed in the first cover 132 may be inclined toward the left at a predetermined angle, for example, and the second discharge holes 138 formed in the second cover 134 may be inclined toward the right at a predetermined angle.

In this case, the wash liquid sprayed from each of the second discharge holes 138 rotates the second arm 130 in a clockwise direction.

Figure 6:
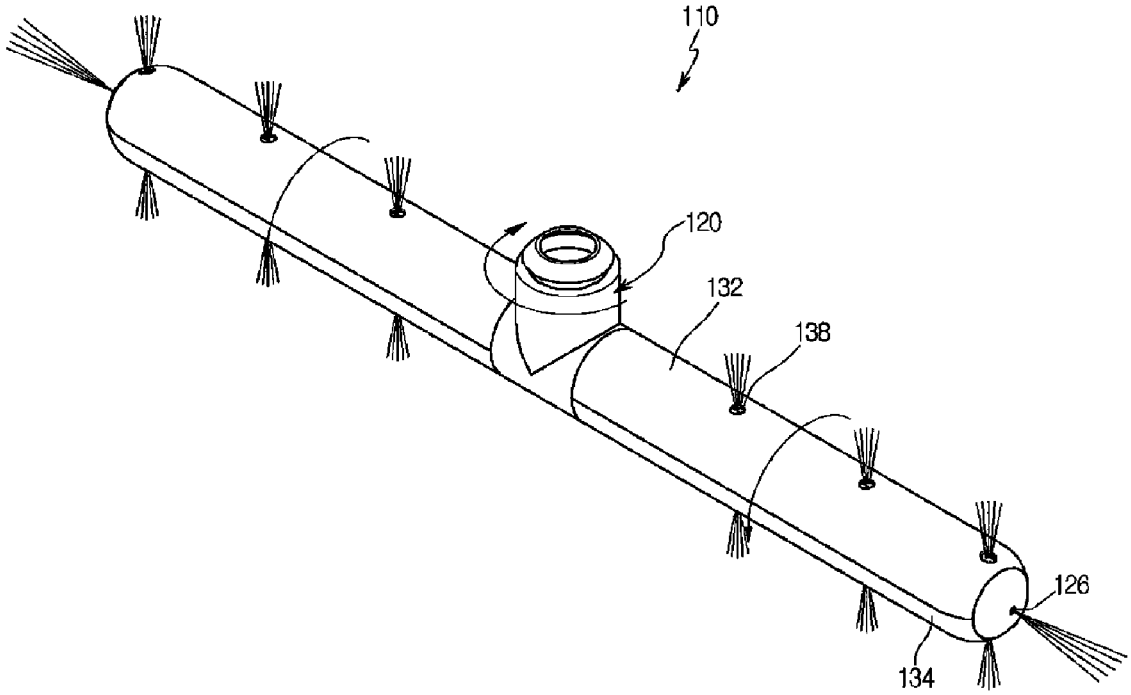
FIG. 6 is a perspective view showing the washing arm in FIG. 3 in operation.

FIG. 6 is a perspective view showing the washing arm in FIG. 3 in operation.

Referring to FIG. 6, when the wash liquid supplied to the sump 60 passes through the arm guide 140 and flows into the spraying portion 110, the first arm 120 rotates in a horizontal direction with respect to the arm guide 140, and the second arm 130 rotates in a vertical direction with respect to the first arm 120.

Specifically, a portion of the wash liquid that flows into the first arm 120 passes through the first discharge hole 126 and is sprayed sideways, and the remaining portion passes through the outlet 124 and is discharged to the outside of the first arm 120, whereupon the discharged wash liquid is sprayed into the tub 30 through the second discharge holes 138 of the second arm 130.

Also, when the wash liquid passes through and is sprayed from the first discharge hole 126, the first arm 120 may rotate in a clockwise direction, for example.

Furthermore, when the wash liquid is sprayed through the second discharge holes 138, the second arm 130 may rotate in a counterclockwise direction with respect to the first arm 120, for example (when seen from the right side in FIG. 6).

Accordingly, because wash liquid is sprayed omni-directionally from the upper arm 100, it is evenly distributed within the tub 30, for a thorough washing of dishes.

In addition, due to the position of the first discharge hole 126, the rotation of the first arm 120 is aided; and the configuration of the second discharge holes 138 enables a smoother rotation of the second arm 130.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing arm comprising:

a first arm having a coupling portion connecting to an arm guide through which wash liquid flows and a spray arm extending to either side of the coupling portion; and a second arm enclosing the spray arm, wherein the spray arm includes a first discharge hole formed in a position offset from a center of a side end surface of the spray arm for supplying wash liquid to a tub and an outlet for discharging the wash liquid into a space formed between the second arm and the spray arm, the second arm includes second discharge holes for spraying wash liquid, and the second discharge holes are tilted with respect to a perpendicular centerline along a longitudinal direction of the second arm.

2. The washing arm according to claim 1, wherein when the first arm and the second arm rotate, respective rotating trajectories thereof perpendicularly intersect one another.

3. The washing arm according to claim 1, wherein the first arm rotates in a horizontal direction, and the second arm rotates in a vertical direction.

4. The washing arm according to claim 1, wherein the spray arm comprises a guide formed at either end thereof, for preventing outward disengagement of the second arm, and the first discharge hole is formed on a side surface of the guide.

* * * * *